United States Patent [19]

Thompson

[11] 4,027,843

[45] June 7, 1977

[54] UNIVERSAL ROCKER

[75] Inventor: Donald R. Thompson, Akron, Ohio

[73] Assignee: The Goodyear Tire & Rubber Company, Akron, Ohio

[22] Filed: Dec. 19, 1975

[21] Appl. No.: 642,519

Related U.S. Application Data

[63] Continuation-in-part of Ser. No. 371,005, June 18, 1973, abandoned.

[52] U.S. Cl. ..... 248/375; 267/145; 297/300; 297/DIG. 1

[51] Int. Cl.[2] ..... A47C 3/02

[58] Field of Search ..... 248/22, 375, 399; 297/300, 313, 314, 325, DIG. 1; 267/133, 143, 145, 152, 153

[56] References Cited

UNITED STATES PATENTS

| | | | |
|---|---|---|---|
| 140,189 | 6/1873 | Doremus | 248/375 |
| 1,696,126 | 12/1928 | Salmon | 297/300 |
| 2,649,136 | 8/1953 | Eames | 297/445 UX |
| 2,740,464 | 4/1956 | Hamilton | 297/349 |
| 2,964,094 | 12/1960 | Gariepy | 248/375 |
| 2,994,110 | 8/1961 | Hardy | 161/190 UX |
| 3,275,131 | 9/1966 | Erickson | 248/22 |
| 3,578,381 | 5/1971 | Young | 297/300 |
| 3,584,858 | 6/1971 | Beck | 267/153 |
| 3,761,130 | 9/1973 | Suzuki et al. | 297/445 |
| 3,770,235 | 11/1973 | Klapproth et al. | 297/300 X |

FOREIGN PATENTS OR APPLICATIONS

| | | | |
|---|---|---|---|
| 850,472 | 9/1970 | Canada | 267/152 |

OTHER PUBLICATIONS

Bender, Handbook of Foamed Plastics, Lake Pub. Corp., Libertyville, Illinois, 1965, p. 222.

*Primary Examiner*—Roy D. Frazier
*Assistant Examiner*—William E. Lyddane
*Attorney, Agent, or Firm*—F. W. Brunner; L. A. Germain

[57] ABSTRACT

A rocker provides complex rocking motion by virtue of a volume-compressible foam section sandwiched between two substantially rigid upper and lower plate sections. The upper plate, volume-compressible foam, and lower plate sections are secured to form a single integral unit that provides complex relative motion between the upper and lower sections, which motion exhibits pitch and roll characteristics about a vertical axis through the center of gravity of the rocker when occupied.

3 Claims, 6 Drawing Figures

UNIVERSAL ROCKER

CROSS REFERENCE TO RELATED APPLICATIONS

This application is a continuation -in-part of application Ser. No. 371,005 filed June 18, 1973, entitled "Foam Spring Rocker" now abandoned.

SUMMARY OF THE INVENTION

This invention relates generally to chairs and more specifically to a chair suitable for rocking and having a unique configuration that allows complex motion about a vertical axis through the center of gravity when the chair is occupied.

There are many and various kinds of rocking chairs available on the market, however, for the most part these prior art chairs are designed to provide rocking limited substantialy to a forward and backward motion through a single angle per motion with reference to the horizontal plane. In order to achieve rocking at more than a single angle, the chairs are usually mounted on a swivel platform for rotation about the vertical axis of the chair. With all of that, these prior art devices are still limited to a single angle, forward and backward, rocking motion.

Therefore, it is a primary object of this invention to provide a chair of the rocker type that exhibits complex motion characteristics about its vertical axis.

Another object of this invention is to provide a rocking chair wherein the rocking motions may be described with reference to pitch and roll characteristics and the combination thereof.

A further object of this invention is to eliminate mechanical devices in rocking chairs and at the same time provide a universal rocking chair exhibiting far greater latitude in its motions than heretofore accomplished.

Yet another object is to provide a simply constructed and economical structure for use in rocking chairs.

These objects and other objects and advantages which will become more evident from the detailed description that follows are provided in a unique chair construction comprising a section of volume-compressible urethane foam sandwiched between two substantially rigid upper and lower support members, the upper member carrying a conventional chair structure while the lower member is attached to a conventional leg support structure.

Description of the Drawings

The features and advantages of the invention will be better understood from a consideration of the description that follows taken in conjunction with the accompanying drawings, in the several figures of which like reference numerals identify like elements, and in which.

DESCRIPTION OF THE PREFERRED EMBODIMENTS

Figure 1:
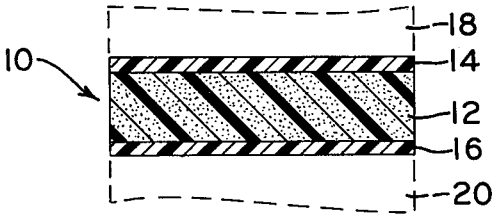
FIG. 1 is a cross-section elevational view showing the principal elements of the invention.

In the drawings, FIG. 1 generally illustrates a unit 10 comprising a central flexible volume-compressible foam section 12 bounded by substantially rigid upper and lower sections 14 and 16, respectively. Secondary elements that are combined to form a complete assembly are shown in dashed-line portions as an attached seat 18 and a platform 20. The central section 12 is preferably a flexible volume-compressible foam having a density of 2–5 pounds per cubic foot, a maximum compression set of 20 percent, and indention and compression load deflections not exceeding 50 percent, when tested to industry standard test methods. Although various organic flexible foams, i.e., urethane, polyethylene, latex, etc. may be used to meet the beforementioned criteria, the preferred material is a flexible polyether based urethane foam. The upper and lower sections 14 and 16 are preferably of a rigid non-compressible high density foam that may be integrally molded to the flexible foam 12 to form a single unit. For reasons of economy in manufacturing, compatible materials that may be molded to form an integral unit 10 are preferred. Other composite structures may be used to form the unit 10, for example, the central portion 12 may be a flexible latex foam and the rigid upper and lower portions may be a wood or wood composition. Many and various combinations of materials may be used to form the foam unit 10, however, consideration should be given to the fact that the flexible material 12 and the upper plate 14 are in relative motion, and delamination of the two materials at the interface is not tolerable. Therefore, materials thay may be molecularly bonded are deemed preferable in this application.

Figure 2A:
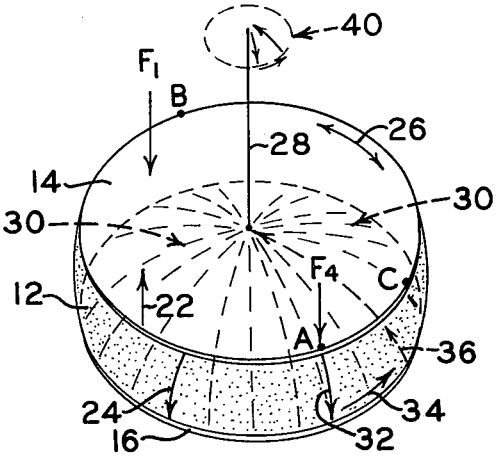
FIG. 2A and 2B are diagrammatic illustrations showing the complex motion achieved by the invention.
Figure 2B:
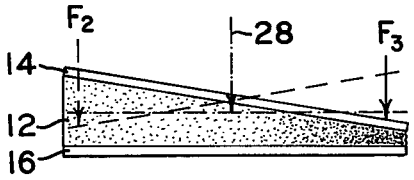

Figs. 2A and 2B attempt to illustrate the complex motion accomplished by the unit 10. To explain the motion, assume that the lower rigid plate 16 is mounted on a stationary platform. The upper plate 14 is free in its movements except for the constraint put on it by its being bonded to the flexible foam 12. The constraint acts to limit its motion in the direction of arrow 22 by the stretch limit of the flexible foam 12, and limits its motion in the direction of arrow 24 by the compressive limit of the foam 12, while its rotational limit in the direction of arrow 26 is met by the shear resistance of the foam. For practical purposes then, the upper plate 14 is limited to move in a rocking motion about the central axis 28 when a force $F_1$ is applied to its upper surface not coaxial with the axis 28. Of course, applying a force along the axis 28 moves the plate 14 to compress the flexible foam 12 an equal depth over the total surface, as illustrated by the dash-dot line in FIG. 2B.

Rocking or pitch motion of the plate 14 is accomplished by applying alternating forces over the surface and these motions may follow any of the dashedline curves 30 illustrated in FIG. 2A. For example, as illustrated in FIG. 2B, when forces $F_2$ and $F_3$ are alternately applied, the plate 14 tends to rock about the central axis 28. In addition to the pitch motion herebefore described, the plate 14 may experience roll motion. For example, consider that points A and B are the front and rear points of the plate 14, respectively, and a force $F_4$ is applied to point A. In this circumstance, plate 14 will pitch in the direction of arrow 32 to compress the flexible foam 12. Now, moving the force $F_4$ along the edge of the plate 14 to point C, rolls the plate in the direction of arrow 34 and the plate 14 is pitched along a new line 36. Removing the force $F_4$ pitches the plate 14 back along the line 36 due to the action of the flexible foam 12 and a pitch-roll-pitch motion is accomplished. The central axis 28 describes the same motion as indicated by the dashed-line arrows at 40. It should be understood that a forward or backward pitch or rock motion may coincide with a roll motion to achieve a total motion that approximates the motion of a rocking ship.

Figure 3:
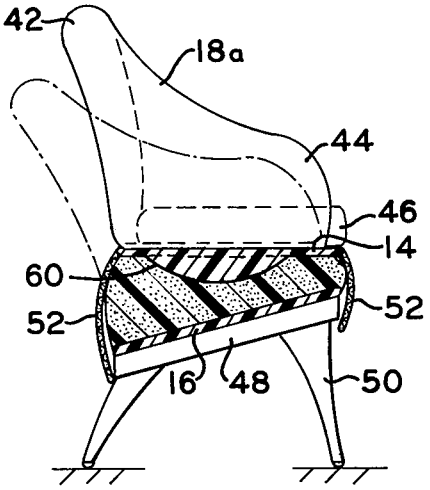
FIG. 3 is a side elevational view partially broken away illustrating the application of the invention to aconventional chair.

FIG. 3 illustrates application of the invention to a standard occasional chair. In the figure, an upper seat portion 18a is secured to the upper plate 14 of the unit 10 and comprises a cushioned back 42, a pair of arms 44 and a cushioned seat pad 46. Secured to the bottom plate 16 is a standard platform 48 that may or may not include legs 50. To complete the structure a curtain or skirt 52 of matching fabric or material surrounds the bottom portion including the unit 10 to provide a pleasing appearance. In this application, the unit 10 is shaped to provide deeper rocking and roll motion directed to the rear of the chair than to the front of the chair. This is accomplished by increasing the foam thickness from front to back as illustrated, with the total amount of rock also dependent upon the density and set characteristics of the flexible foam 12. An additional method of changing the rock/roll characteristics of the seat 18*a* is to configure the plate 14 to further limit its compressing the flexible foam 12, as for example, by molding a node 60 on the underside thereof. The node not only limits the downward movement but increases the shear surface of the plate 14 to provide additional stability. The node may also be approximated by configuring the seat to include the upper plate 14 as will hereinafter be described with reference to FIGS. 4 and 5.

Figure 4:
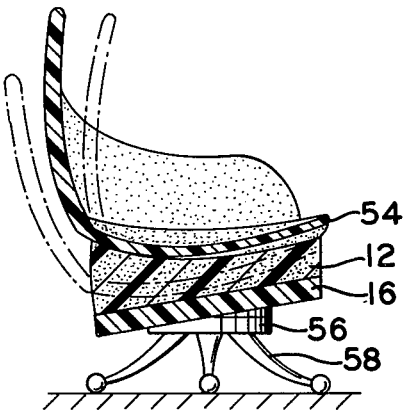
FIG. 4 is a side elevational view partially broken away to illustrate the application to a completely molded swivel chair.
Figure 5:
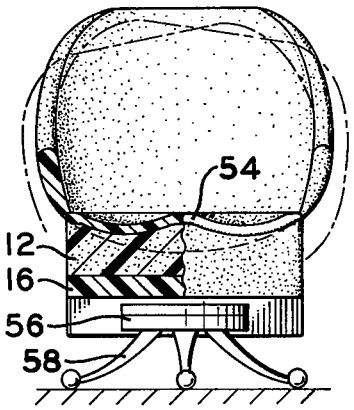
FIG. 5 is a front elevational view partially broken away of the chair of FIG. 4.

FIGS. 4 and 5 illustrate the application of the invention to a completely molded chair. In this respect, the back, arms, and seat, are integrally molded with the seat portion 54 serving as the upper plate 14 of the unit 10. Secured to the bottom plate 16 is a conventional swivel 56 and caster-legs 58. The chair of FIG. 4 may be considered a universal chair as it affords unlimited motion and movement by virtue of the flexible foam unit 10, swivel, and caster combination. As illustrated in FIG. 5, the seat 54 is molded to a typical formed seat configuration that not only adds to the esthetic appearance and comfort but also provides lateral stability due to the increased shear surface. It is comtemplated that the total assembly including seat 54, flexible foam 12, and lower plate 16, will be molded into a single integral unit with the addition of a lower platform to be left as the only part to be assembled thereto.

While certain representative embodiments and details have been shown for the purpose of illustrating the invention, it will be apparent to those skilled in the art that various changes and modifications may be made thereto without departing from the spirit or scope of the invention.

What is claimed is:

1. A chair suitable for rocking comprising in combination:

A. an upper seat;

B. a lower platform, and

C. a central unit comprising a thickness of an organic, volume-compressible, flexible polyether based urethane foam having a density of 2–5 pounds per cubic foot, a maximum compression set of 20 percent, and indention and compression load deflections not exceeding 50 percent, said foam bounded by substantially rigid upper and lower sections of a noncompressible, high density foam molded to the flexible foam to form a single integral unit, the upper section securely attached to the seat and characterized by a downwardly directed nodal protrusion penetrating into the flexible foam to increase the shear surface between the rigid upper section and the flexible foam, the lower section securely attached to the platform, said central unit providing complex pitch and roll motion about a vertical axis through the center of gravity when the chair is occupied.

2. The chair according to claim 1, wherein the upper seat, lower platform, and central unit are molded to form a single integral unit.

3. The chair according to claim 1 wherein the upper section is molded in a form-fitting seat configuration and the nodal protrusion is integrally molded as part of the seat.

* * * * *